US005140150A

United States Patent [19]

Cosijn

[11] Patent Number: 5,140,150

[45] Date of Patent: Aug. 18, 1992

[54] BRIGHTNESS INTENSIFIER TUBE COMPRISING SEALS

[75] Inventor: Johannes C. M. Cosijn, Eindhoven, Netherlands

[73] Assignee: U.S. Philips Corp., New York, N.Y.

[21] Appl. No.: 629,535

[22] Filed: Dec. 18, 1990

[30] Foreign Application Priority Data

Dec. 21, 1989 [NL] Netherlands ..... 8903130

[51] Int. Cl.[5] ..... H01J 31/50

[52] U.S. Cl. ..... 250/213 VT; 313/525

[58] Field of Search ..... 250/213 VT; 313/525, 313/526, 527, 528, 541, 542, 543, 544, 383, 390

[56] References Cited

U.S. PATENT DOCUMENTS

Re. 30,596 4/1981 Cuelenaera et al. ..... 250/213 VT
3,510,925 5/1970 Fleck ..... 313/544
4,171,480 10/1979 Wulms ..... 250/213 VT
4,554,481 11/1985 Faulkner et al. ..... 313/541
4,831,249 5/1989 Van Der Velden et al. ..... 250/213 VT
4,855,587 8/1989 Creusen et al. ..... 250/213 VT
4,960,987 10/1990 Frank ..... 250/213 VT
4,996,414 2/1991 Frank et al. ..... 250/213 VT

*Primary Examiner*—David C. Nelms
*Assistant Examiner*—John R. Lee
*Attorney, Agent, or Firm*—William L. Botjer

[57] ABSTRACT

A brightness intensifier tube is composed of a cylindrical sleeve portion comprising supporting faces acting as reference surfaces for an entrance window and an exit screen so that a vacuum tight tube with exactly positioned parts can be formed by way of seals provided by application of a single compressive load. Because electrodes of an electron optical imaging system are supported by the windows or the sleeve portion in an exactly positioned fashion, assembly produces exact positioning of the electrode system in the tube.

8 Claims, 1 Drawing Sheet

BRIGHTNESS INTENSIFIER TUBE COMPRISING SEALS

BACKGROUND OF THE INVENTION

The invention relates to a vacuum tight brightness intensifier tube, comprising an envelope which is composed of a cylindrical sleeve portion which includes a radial supporting face for an entrance window at a first axial end, and a radial supporting face for an exit screen at a second axial end, said envelope accommodating an exactly positioned electron-optical imaging system. The invention also relates to the manufacture of such a tube.

A brightness intensifier tube of this kind is known from U.S. Pat. No. 4,171,480.

Assembly of such a tube usually requires many operations, for example the vacuum tight mounting of an exit window on a cylindrical wall portion, the mounting of an electron optical system in a bush thus formed, and the vacuum tight mounting of an entrance window. It is of essential importance that the electron optical system is exactly positioned and that distortion or contamination of the tube is prevented during the mounting of, for example, windows. In practice this implies a comparatively costly mounting procedure which often involves a comparatively high percentage of rejects.

SUMMARY OF THE INVENTION

It is inter alia an object of the invention to allow for substantially faster assembly of the tube while maintaining or even improving exactness of electrode positioning. To achieve this, a vacuum tight brightness intensifier tube of the kind set forth in accordance with the invention is characterized in that a sleeve portion, an entrance window and an exit screen provided with reference surfaces for mutually exact positioning are joined by applying a single compressive load to sealing material provided therebetween.

Because said components can be joined by single compressive loading, undesirable distortion as well as contamination of the tube can be avoided and inexpensive assembly is possible. Using this method of assembly, the risk of adverse non-parallelism of the entrance window and the exit window is also reduced.

In a preferred embodiment, prior to being mounted, an entrance window is provided with a photocathode on an inner surface, assembly being executed so that the photocathode cannot be contaminated.

In a further preferred embodiment, a further electrode of the electron-optical system is formed by a conductive layer deposited on an inner surface of a calibrated sleeve portion. For a diode tube, the further electrode can be electrically conductively connected to an entrance electrode formed by the photocathode.

In a further preferred embodiment, a part of the sleeve portion which is situated near the exit screen is covered with a layer of transparent chromium oxide, enabling activation of the photocathode with light impinging on the photocathode from inside the tube, and avoiding the occurrence of electrical discharge phenomena at that area.

In another preferred embodiment, the sleeve portion of the envelope is provided with a third supporting face for the further electrode, for example in the form of a local constriction in the sleeve portion. The supporting face can then also serve as a supporting face for a joint between two sleeve portions or between a sleeve portion and an exit screen support. In the latter case the electrode can be mounted utilizing the compressive load applied for joining the sleeve portion and the windows. However, alternatively the electrode can first be mounted on a collar of a constriction, exact positioning of the electrode with respect to a central optical axis of the tube being realized by reference to a calibrated sleeve portion and an electrode aperture positioned exactly with respect to a mounting flange.

In another preferred embodiment, the exit screen comprises a matrix of semiconductor electron detectors or a combination of a phosphor screen and a matrix of photodiodes.

In yet another preferred embodiment, the tube is accommodated in a metal housing which also accommodates a power supply generator.

BRIEF DESCRIPTION OF THE DRAWING

Some preferred embodiments in accordance with the invention will be described in detail hereinafter with reference to the drawing. Therein.

DETAILED DESCRIPTION OF THE PREFERRED EMBODIMENT

Figure 1:
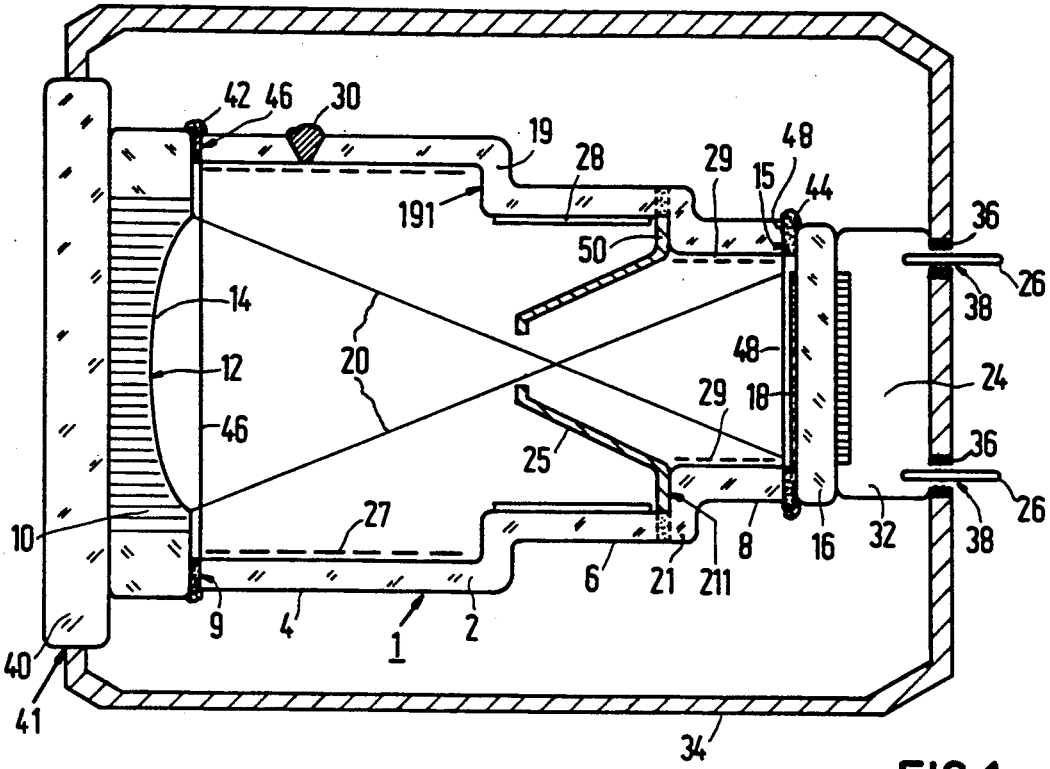
FIG. 1 is a sectional view of an embodiment of a brightness intensifier tube in accordance with the invention.

FIG. 1 of the drawing shows a brightness intensifier tube 1 which comprises a cylindrical sleeve portion 2 which is in this case composed of three axially successive circular-cylindrical bushes 4, 6 and 8. At a first end 9 the sleeve portion 2 is closed by an entrance window 10 which is in this case formed by a fiber optical plate. A spherically curved inner surface 12 of the entrance window 10 supports a photocathode 14. At an opposite axial end 15 the sleeve portion is closed by an exit screen 16 which in this case consists of a glass plate, for example a fiber-optical plate, and which supports a fluorescent layer 18. Between the bushes 4 and 6 there is provided a constriction with a reference surface 191 and between the bushes 6 and 8 a constriction 21 with a reference surface 21. A beam of image carrying photoelectrons 20 emanating from the photocathode 14 is imaged on the fluorescent layer 18 by means of an electron optical system 22. An optical image formed thereon is subsequently detected by means of a sensor 24 and can be read via connection pins 26. The electrode system 22 comprises a bush-shaped electrode 25 and, in addition to the photocathode which serves as an entrance electrode and the fluorescent layer 18 which serves as an exit electrode, electrodes 27, 28 and 29 which are provided on inner surfaces of the bushes 4 and 8. In the case of a diode version, the electrode 27 is electrically short-circuited to the photocathode; in the case of, for example a triode version, it can be maintained at a desired potential from an external source via a glass passage 30. The electrode 29, provided in the bush 8, is preferably electrically connected to the luminescent layer 18 which has been rendered electrically conductive. To achieve this, a luminescent layer may be provided with a so-called metal backing which is sufficiently thick for electrical conductivity but thin enough so as not to impede incident, comparatively high-energy photoelectrons. The exit screen 16 may also be formed by a closing plate which in that case need not necessarily be made of glass and on which a semiconductor detection device is provided instead of a luminescent layer, for example a device in the form of a matrix of electron detection elements or a combination of luminescent material and photodiodes. The photodiodes may then also form part of an image detection device 32 which is, therefore, optically or electrically coupled to the luminescent layer or to the matrix of p-n detectors.

In the present embodiment the tube is accommodated in a metal housing 34 which constitutes a rugged shield for the tube but which can also act as a shield against disturbing electrical and/or magnetic fields. Besides openings 38 which are provided with electrical insulation 36 and which serve for the contact pins 26, the housing comprises merely an opening 41 which is closed by a window 40 which is transparent to radiation to be detected. The housing 34 may accommodate (not shown) electronic circuitry for power supply and control and also a voltage generator. The entrance window and the exit window are connected to the sleeve portion via seals 42 and 44. To this end, the envelope portion is provided at an entrance side with an end face 46 which is situated in a radial plane and with an end face 48 which is situated in a radial plane at an exit side. The planes 46 and 48 extend in parallel so that, inter alia because of a sufficiently ruggedly constructed sleeve portion, the entrance window, the sleeve portion and the exit window can form a vacuum tight tube by way of seals formed by single compressive loading. The seals 42 and 44 consist, for example of indium-tin or indium-lead combinations.

Because the electrodes of the electron optical system are mounted directly on wall portions of the tube or are mounted therein with an unambiguous fit like the electrode 25, for example in that a mounting ring 50 thereof fits exactly in a calibrated bush 6 of the sleeve portion, the tube assembly also produces exact electrode positioning.

Radial positioning can also be provided with respect to a central axis of the bush assembly.

Figure 2A:
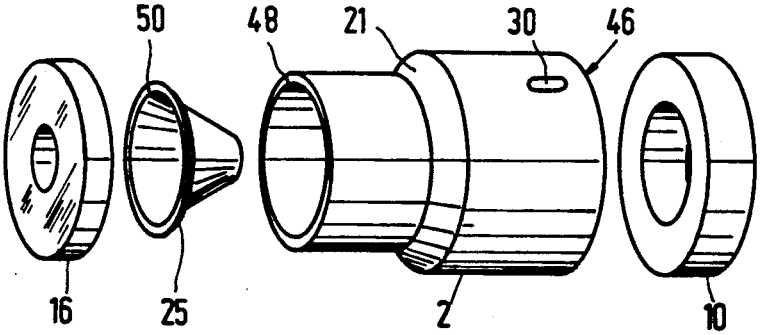
FIGS. 2*a* and 2*b* show embodiments of constituent components of such tubes.
Figure 2B:
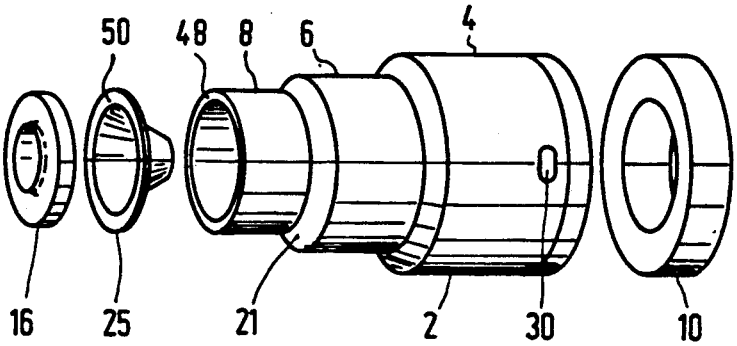

For the sake of clarity, FIG. 2 shows the components to be assembled for a two-stage diode sleeve and a three-stage triode sleeve. FIG. 2*a* shows the entrance window 10, (the cylindrical sleeve portion 2), with reference faces 46 and 48 and with the constriction 21 having a reference face 211 and for the triple bush shaped housing further with a constriction 31 and a reference face 311, the electrode 25 and the exit screen 16 of a diode tube. All these components can be joined in a single operation by way of an axially directed compression/thermal treatment. The same holds good for the corresponding components of a triode tube, where the passage 30 for the electrode 27 is indicated in the cylindrical sleeve portion 2.

I claim:

1. A vacuum tight brightness intensifier tube, comprising an envelope which is composed of a cylindrical sleeve portion which includes a radial supporting face for an entrance window at a first axial end and a radial supporting face for an exit screen at a second axial end, said envelope accommodating an exactly positioned electron-optical imaging system, wherein a sleeve portion, an entrance window and an exit screen are provided with reference surfaces for mutually exact positioning and are joined by applying a single compressive load to sealing material disposed therebetween.

2. A brightness intensifier tube as claimed in claim 1, further including a bush-shaped electrode disposed in the electron optical imaging system.

3. A brightness intensifier tube as claimed in claim 1, further including electron optical parts in the electron optical system which are formed by electrically conductive layers provided on calibrated inner surfaces of the cylindrical sleeve portion.

4. A brightness intensifier tube as claimed in claim 1 characterized in that portions of inner sleeve surfaces which do not carry electrodes are covered with a preferably transparent chromium-oxide layer.

5. A brightness intensifier tube as claimed in claim 1 characterized in that the exit screen is formed by an optical window which supports a layer of luminescent material on an inner surface.

6. A brightness intensifier tube as claimed in claim 1 characterized in that the exit screen is formed by a cover plate which supports a matrix of electron detection elements on an inner surface.

7. A brightness intensifier tube as claimed in claim 1 characterized in that it is accommodated in a metal housing which comprises at an entrance side a window which is transparent to radiation to be measured, at an exit side of the housing there being provided insulated connection pins which serve for an image pick-up device detecting the output image.

8. A brightness intensifier tube as claimed in claim 7, characterized in that the housing is made of magnetic shielding material.

* * * * *